United States Patent [19]

Chupak et al.

[11] Patent Number: 4,768,975

[45] Date of Patent: Sep. 6, 1988

[54] INSULATION DISPLACEMENT TERMINAL

[75] Inventors: John M. Chupak, West Middlesex, Pa.; Frederick H. Rider, Jr., Youngstown, Ohio

[73] Assignee: General Motors Corporation, Detroit, Mich.

[21] Appl. No.: 526,687

[22] Filed: Aug. 26, 1983

[51] Int. Cl.[4] ..... H01R 4/24

[52] U.S. Cl. ..... 439/397; 439/436; 439/439; 439/474

[58] Field of Search ..... 339/95 R, 96, 97 R, 339/97 P, 98, 99 R

[56] References Cited

U.S. PATENT DOCUMENTS

| | | | |
|---|---|---|---|
| 3,659,243 | 4/1972 | Gluntz | 339/258 R X |
| 3,718,888 | 2/1973 | Pasternak | 339/98 |
| 3,805,214 | 4/1974 | Demler, Sr. et al. | 339/17 |
| 4,088,382 | 5/1978 | Ichimura | 339/99 R |
| 4,097,107 | 6/1978 | Hawkins | 339/97 R |
| 4,136,920 | 1/1979 | Scholtholt | 339/98 |
| 4,324,450 | 4/1982 | Weisenburger et al. | 339/97 R |
| 4,348,072 | 9/1982 | Gudaitis et al. | 339/97 R |

FOREIGN PATENT DOCUMENTS

| | | | |
|---|---|---|---|
| 7708720 | 2/1978 | Netherlands | 339/99 R |

OTHER PUBLICATIONS

ITW Fastex Bulletin, "Blade Grounding Clips", 1973.

*Primary Examiner*—Gil Weidenfeld
*Assistant Examiner*—Steven C. Bishop
*Attorney, Agent, or Firm*—F. J. Fodale

[57] ABSTRACT

An insulation displacement terminal comprises a base having a pair of integrally connected side plates and an integrally connected flex arm disposed between the side plates. The side plates have guide grooves formed in part by inwardly staggered legs. The flex arm has laterally spaced plates which bias an insulated conductor received in the guide grooves against the edges of inwardly staggered legs of the side plates to establish a four point electrical contact with the core of the insulated conductor under the constant pressure of the flex arm.

2 Claims, 1 Drawing Sheet

INSULATION DISPLACEMENT TERMINAL

This invention relates generally to insulation displacement terminals and, more particularly, to insulation displacement terminals comprising a pair of laterally spaced, slotted plates which receive an insulated conductor parallel to its axis.

It is already known from U.S. Pat. No. 4,088,382 granted to Yoshiaki Ichimura on May 9, 1978 to provide a terminal of the above noted type which further includes a substantially rigid center contact blade disposed between the slotted plates. This center contact blade 18 has an edge 42 which is disposed on the centerline of the plate slots 24,25 so that a three point contact is established with the conductor core after the insulation is slit and split by the slots 24,25 and specially shaped plates 26,27 as best illustrated in FIGS. 6 and 7 of the Ichimura patent.

The object of our invention is to provide an improved insulation displacement terminal of the above-noted type. A significant feature of our invention is that the terminal has a flex arm for establishing an electrical contact with the conductor core which is under the constant pressure of the flex arm.

Another feature of our invention is that the insulation displacement is accomplished by the cooperation of the flex arm and, consequently, the dimension of the plate slots is not critical.

Another feature of our invention is that the flex arm is spring loaded and properly positioned for receipt of the insulated conductor in the plate slots.

Another feature of our invention is that the terminal establishes four point contact with the conductor core under the constant pressure of the flex arm.

Yet another feature of our invention is that the terminal has a stop tab to prevent overstressing of the flex arm.

Other objects and features of the invention will become apparent to those skilled in the art as the disclosure is made in the following detailed description of a preferred embodiment of the invention as illustrated in the accompanying sheet of drawing in which.

Figure 1:
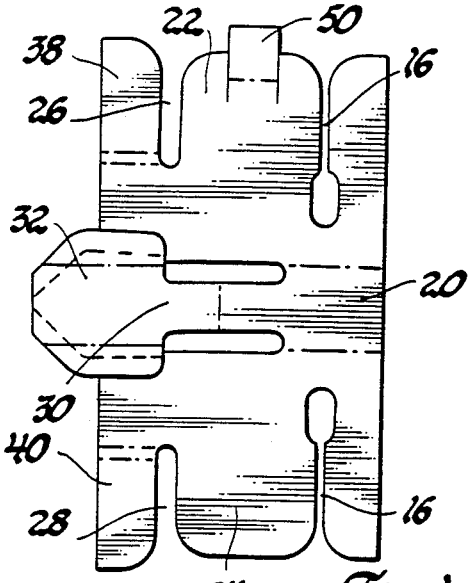
FIG. 1 is a plan view of a stamped sheet metal blank for constructing an insulation displacement terminal in accordance with our invention.
Figure 2:
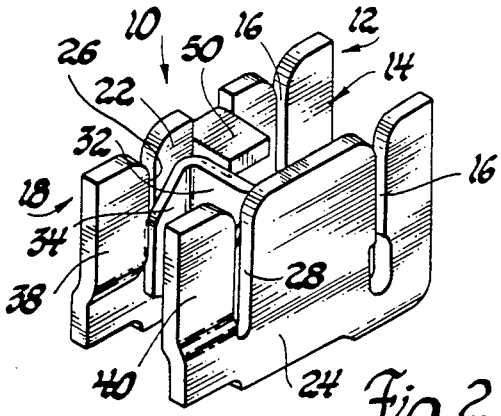
FIG. 2 is a perspective view of an insulation displacement terminal made from the stamped sheet metal blank shown in FIG. 1.

Referring now to the drawing, our invention is illustrated in conjunction with an insulation displacement terminal 10 for connecting conductors. Consequently, the contact portion 12 of the terminal is in the form of a conventional U-shaped insulation displacement member 14 having a pair of narrow, aligned slots 16 for receiving and piercing the insulation of an insulated conductor (not shown). It should be understood, however, that our invention can be utilized with other types of insulation displacement terminals such as those in which the contact portion 12 is in the form of a socket, a blade, a pin, a ring or any other suitable structure for making an electrical contact with another electrical device or terminal.

Our invention is concerned with the insulation displacement portion of the terminal 10 indicated generally at 18. In this regard, the terminal 10 comprises a base 20 having a pair of laterally spaced side plates 22 and 24 integrally connected to the opposite longitudinal edges of the base 20. The side plates 22,24 are bent up perpendicularly to the base 20 so that the side plates 22,24 are laterally spaced from each other and substantially parallel to each other. As indicated above, the base 20 and side plates 22,24 also form a conventional, U-shaped insulation displacement member 14 which does not form a part of the invention, per se, as other forms of the contact portion are contemplated.

Figure 5:
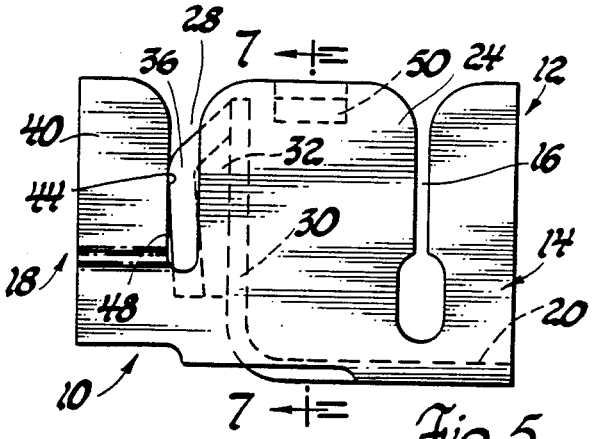
FIG. 5 is a side view of the insulation displacement terminal shown in FIG. 3 taken substantially along the line 5—5 looking in the direction of the arrows.
Figure 6:
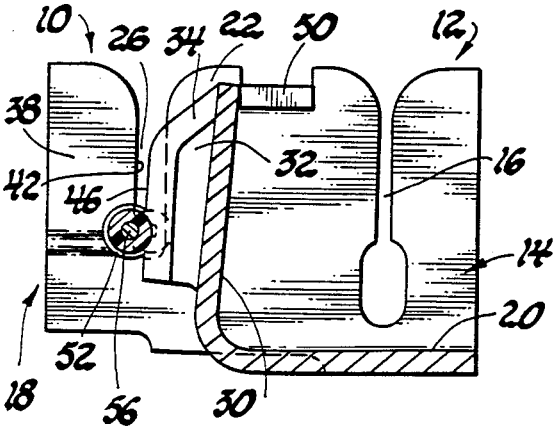
FIG. 6 is a section taken substantially along the line 6—6 of FIG. 4 looking in the direction of the arrows.
Figure 7:
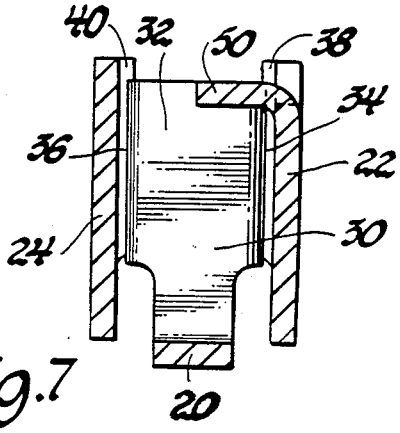
FIG. 7 is a section taken subtantially along the line 7—7 of FIG. 5 looking in the direction of the arrows.

Each of the side plates 22,24 has a guide slot 26 or 28 in the insulation displacement portion 18. The guide slots 26,28 are aligned with each other so as to receive an insulated conductor parallel to its axis. In this particular instance, the guide slots 26,28 are open at the free sides of the side plates 22,24 and extend transversely toward the sides connected by the base 20. The guide slot openings are defined by large radiuses, as best shown in FIG. 5, to facilitate insertion of the insulated conductor. The width of the guide slots 26,28 is not critical, however, the width is preferably substantially equal to the diameter of the insulated conductor which is to be inserted therein for termination.

Figure 3:
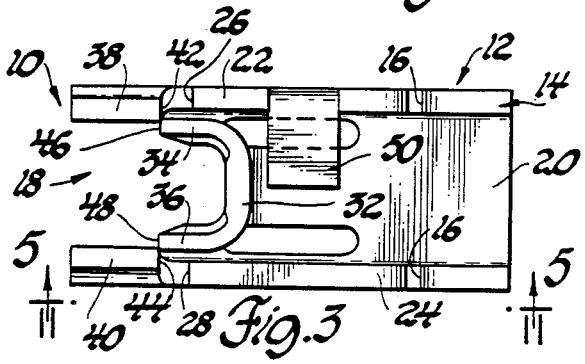
FIG. 3 is a top view of the insulation displacement terminal shown in FIG. 2.

The insulation displacement portion 18 also includes a flex arm 30 which is integrally connected at one end to the base 20 and bent upright so that it lies between the side plates 22 and 24. The free end of the flex arm 30 has a U-shaped portion 32 which provides a pair of laterally spaced blades 34 and 36 which are juxtaposed the side walls 22,24, respectively, and which extend past the guide slots 26,28 as best shown in FIG. 5. The side plates 22,24 each have a leg 38,40 on the side of the guide slots 26,28 which is remote from the flex arm 30. The legs 38,40 are staggered inwardly toward each other so that the edges 42,44 of the guide slots 26,28 form stops for confronting edges 46,48 of the flex arm 30 as best shown in FIGS. 3. The edges 42, 44, 46 and 48 which form four insulation displacement edges cooperating in two scissor-like pairs are preferably coined as best shown in FIGS. 3 and 5 to enhance their insulation piercing quality.

The flex arm 30 is spring loaded against the edges 42,44 to assure proper positioning of the flex arm 30 for receipt of an insulated conductor in the guide slots 26,28 and the subsequent operation of the flex arm 30 in cooperation with the edges 42,44. The upper edges 46 and 48 of the blades 34,36 are ramped as shown in FIG. 5 so that the flex arm 30 is cammed away from the edges 42,44 as the insulated conductor is inserted deeper into the guide slots 26,28. The side plate 22 also has a tab 50 which is bent inwardly toward the side plate 24 to provide a stop which limits the movement of the flex arm 30 away from the slots 26,28.

Figure 4:
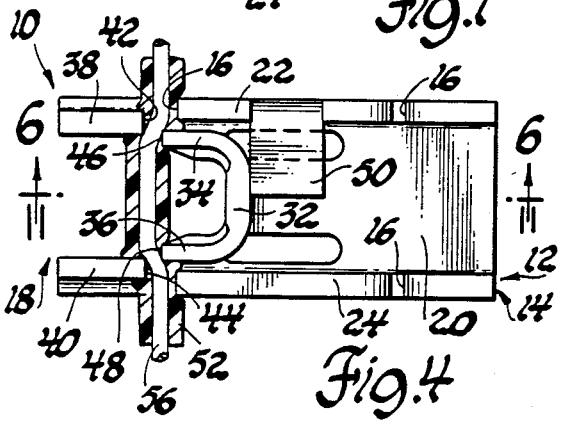
FIG. 4 is a top view of the insulation displacement terminal attached to an insulated conductor.

The insulated conductor 52 is attached by inserting it parallel to its axis into the generously radiused, open ends of the guide slots 26 and 28. As the insulated conductor 52 is pushed deeper into the guide slots 26,48, the flex arm 30 is cammed away from the edges 42,44 under the action of the ramp surfaces 46,48 and increasing the bias of the flex arm 30. The coined insulation piercing edges 42, 44, 46 and 48 then cut through the insulation with a cooperative scissor-like action and establish a four point electrical contact with the core 56 of the conductor under the constant pressure of the flex arm 30 which may be supported by the tab 50 to prevent overstressing as best shown in FIG. 4.

We wish it to be understood that we do not desire to be limited to the exact details of construction shown and described, for obvious modifications will occur to a person skilled in the art.

The embodiments of the invention in which an exclusive property or privilege is claimed are defined as follows:

1. An insulation displacement terminal comprising, a base having a pair of laterally spaced, side plates integrally connected to opposite longitudinal edges of the base and bent up generally perpendicular thereto, each of said side plates having a guide slot aligned with the guide slot in the other side plate for receiving an insulated conductor parallel to its axis, each of said side plates having a leg on one side of the guide slot which is staggered inwardly toward the leg of the other side plate and which has an insulation piercing edge, and a flex arm integrally connected at one end to the base and bent upright so that it is disposed transversely between the side plates, said flex arm having a U-shaped portion at its free end comprising laterally spaced blades adjacent the side plates, respectively, said laterally spaced blades having insulation piercing edges for piercing an insulated conductor disposed in the guide slots of the side plates and biasing the insulated conductor against the insulation piercing edges of the staggered legs on the one side of the guide slots whereby four point contact is established with the core of the insulated conductor under the constant contact pressure of the flex arm, and the laterally spaced blades of the flex arm biasingly engaging the staggered legs of the side plates to assure proper positioning of the flex arm for receipt of an insulated conductor in the guide slots of the side plates.

2. The insulation displacement terminal as defined in claim 1 wherein one of the side plates has a stop tab extending inwardly toward the other of the side plates for limiting movement of the flex arm away from the guide slots in the side plates.

* * * * *